US005676240A

United States Patent [19]

Cziraky et al.

[11] Patent Number: 5,676,240

[45] Date of Patent: Oct. 14, 1997

[54] CADDY FOR ART SUPPLIES

[75] Inventors: David A. Cziraky, Bethlehem; Harry J. Lidle, Jr., Macungie, both of Pa.; Richard A. Tarozzi, Gales Ferry, Conn.

[73] Assignee: Binney & Smith Inc., Easton, Pa.

[21] Appl. No.: 426,623

[22] Filed: Apr. 20, 1995

[51] Int. Cl.[6] ..... B05C 13/10

[52] U.S. Cl. ..... 206/1.7; 206/371; 206/373; 220/4.27; 220/520

[58] Field of Search ..... 206/1.7, 371, 372, 206/373, 581, 512, 315.11; 220/4.27, 503, 520

[56] References Cited

U.S. PATENT DOCUMENTS

| | | | |
|---|---|---|---|
| D. 90,769 | 9/1933 | Kamen | D19/36 |
| D. 153,339 | 4/1949 | Deckinger | D74/1 |
| 173,269 | 2/1876 | Chinnock . | |
| 193,464 | 7/1877 | Shepherd . | |
| D. 236,556 | 8/1975 | Di Paola et al. | D87/3 R |
| D. 251,213 | 2/1979 | Rodin et al. | D87/1 R |
| D. 255,251 | 6/1980 | Hansen et al. | D19/88 |
| D. 257,994 | 1/1981 | Kroll | D21/59 |
| D. 261,903 | 11/1981 | Mulder | D19/88 |
| 274,629 | 3/1883 | Merrill . | |
| D. 279,489 | 7/1985 | Mak | D21/59 |
| D. 282,752 | 2/1986 | Olivetti | D19/26 |
| D. 282,792 | 3/1986 | Zinberg | D6/406 |
| D. 293,739 | 1/1988 | Nadeau | D3/73 |
| D. 293,740 | 1/1988 | Nadeau | D3/73 |
| D. 313,819 | 1/1991 | Craft, Jr. et al. | D19/88 |
| D. 326,279 | 5/1992 | Logan | D19/36 |
| D. 330,045 | 10/1992 | Dietterich et al. | D19/36 |
| D. 332,466 | 1/1993 | Logan | D19/36 |
| D. 335,896 | 5/1993 | Evenson | D19/83 |
| D. 338,496 | 8/1993 | Tarozzi | D19/85 |
| D. 340,803 | 11/1993 | Bradford et al. | D3/74 |
| D. 341,714 | 11/1993 | Ancona et al | D3/20 |
| D. 351,504 | 10/1994 | Tarozzi | D3/276 |
| D. 351,727 | 10/1994 | Tarozzi | D3/276 |
| D. 356,823 | 3/1995 | Tarozzi | D19/36 |
| D. 358,708 | 5/1995 | Ko | D3/276 |
| 363,894 | 5/1887 | Heinig | 206/1.7 X |
| 791,506 | 6/1905 | Simmons . | |
| 1,193,181 | 8/1916 | Peck . | |
| 1,239,023 | 9/1917 | McElhinny . | |
| 1,542,115 | 6/1925 | Weis | 220/4.27 |
| 1,559,665 | 11/1925 | Beery et al. . | |
| 1,625,647 | 4/1927 | Gillan . | |
| 1,992,630 | 2/1935 | Piperoux | 206/373 |
| 2,676,777 | 4/1954 | Moushon | 248/198 |
| 2,875,010 | 2/1959 | Sola et al. | 220/520 |
| 3,334,714 | 8/1967 | Gordon | 190/57 |
| 3,352,616 | 11/1967 | Linger | 312/231 |
| 3,392,868 | 7/1968 | Pfrommer | 220/520 |
| 3,459,327 | 8/1969 | Harris | 220/520 |
| 3,768,177 | 10/1973 | Thomas | 35/27 |
| 3,831,805 | 8/1974 | Yonce | 220/520 |
| 3,876,271 | 4/1975 | Shirlock | 312/310 |
| 4,061,224 | 12/1977 | Fuhri | 206/1.7 |
| 4,294,348 | 10/1981 | Hastings | 206/1.7 |
| 4,318,471 | 3/1982 | Hutton | 206/214 |
| 4,480,744 | 11/1984 | Blackmon | 206/1.7 |

(List continued on next page.)

FOREIGN PATENT DOCUMENTS 27094 12/1954 Finland .

OTHER PUBLICATIONS

Gift & Tableware Reporter, Sep. 7, 1964, p. 25, see "Clip Caddy" with drawer, lower left –D 19/88.

Crayola® Draw 'N' Do Desk –Color Photocopy of Binney & Smith Inc. 1984 Catalog, one page.

(List continued on next page.)

*Primary Examiner*—David T. Fidei

*Attorney, Agent, or Firm*—Leydig, Voit & Mayer, Ltd.

[57] ABSTRACT

A caddy for storing and transporting art supplies is disclosed. The caddy includes at least two pivotably coupled trays disposed in substantially parallel, vertically displaced, planes. Access to the contents of the lower tray or trays is obtained by pivoting one or more of the trays.

31 Claims, 8 Drawing Sheets

U.S. PATENT DOCUMENTS

| | | | |
|---|---|---|---|
| 4,561,705 | 12/1985 | Schafer | 312/244 |
| 4,765,470 | 8/1988 | Curci | 206/315.11 |
| 4,807,773 | 2/1989 | Tsai | 220/4.27 |
| 4,815,483 | 3/1989 | Du Grenier et al. | 220/4.27 |
| 4,821,751 | 4/1989 | Chen | 206/581 |
| 4,848,585 | 7/1989 | Snyder | 206/315.11 |
| 4,971,284 | 11/1990 | Curry | 248/460 |
| 5,163,845 | 11/1992 | Blassingame | 434/408 |
| 5,190,151 | 3/1993 | Dietterich | 206/214 |
| 5,246,020 | 9/1993 | Wu | 206/581 |
| 5,248,030 | 9/1993 | Tarozzi | 206/1.7 |
| 5,259,502 | 11/1993 | Chan | 220/4.27 |
| 5,284,445 | 2/1994 | Dietterich et al. | 434/419 |
| 5,346,091 | 9/1994 | Hsu | 220/503 |
| 5,388,689 | 2/1995 | Kroop et al. | 206/214 |
| 5,393,030 | 2/1995 | Tarozzi | 248/460 |
| 5,441,163 | 8/1995 | Carrasco | 206/273 |

OTHER PUBLICATIONS

Crayola® Deluxe Art Kit –Color Photocopy of Binney & Smith Inc. 1984 Catalog, one page.

Crayola® Coloring Tote –Color Photocopy of Binney & Smith Inc. 1984 Catalog, one page.

Crayola® Drawing Portfolio –Color Photocopy of Binney & Smith Inc. 1993 Catalog, one page.

Sesame Street My First Easel –Assembly Instructions, Avalon, Division of Craft House Corporation, Toledo, Ohio ©1984.

CADDY FOR ART SUPPLIES

FIELD OF THE INVENTION

This invention relates generally to storage containers and, more particularly, to a caddy for storing and transporting art supplies.

BACKGROUND OF THE INVENTION

Artists often travel with their art supplies. For example, if an artist is sketching or painting a landscape, an artist might travel to the site of their work to view the landscape in person as they create. Similarly, if an artist wishes to paint or draw a building or a person, it is sometimes advantageous for the artist to travel to the location of the building or person to view the subject as the artist creates the artwork. Unfortunately, the advantages gained by traveling to the site of the artist's subject are somewhat counterbalanced by the logistical difficulties inherent in transporting the artist's supplies. For example, in order to paint a picture, an artist would require multiple paint brushes, multiple paints and a supply of paper or the like. It can be very difficult and burdensome to store and transport an array of supplies such as this without damaging the supplies and the artwork.

Similarly, it is often desirable for children to travel with art supplies. For example, if a family is traveling for a relatively long period of time, it is often necessary to keep a child entertained. One way to accomplish this task is to provide the child with art supplies such as crayons, coloring pencils, and paper to use during the trip. However, it can be difficult to store and transport these supplies without soiling either the child, the vehicle, or the supplies. For example, it is often easy to drop or crumple drawing paper thereby leaving it in an unusable state when moving the child and the supplies from location to location. Similarly, it can be easy to inadvertently mark the surrounding environment or lose one or more writing instruments when traveling.

Also, it is desirable for the caddy and art supplies to be stored at home or at the home of a friend or relative. For example, when the child visits the friend or relative, the art supplies are stored in one location in the caddy and the child can readily access the art supplies. After the child has stopped using the art supplies, the art supplies can be stored in the caddy for the next visit by the child.

OBJECTS OF THE INVENTION

It is, therefore, a general object of the present invention to provide a caddy for storing and transporting art supplies. More specifically, it is an object of the invention to provide an improved caddy for storing both paper and other art supplies such as scissors, writing utensils and paints in a single, transportable carrying unit. It is a related object to provide a caddy for storing and transporting paper and other supplies wherein the paper is kept in a separate cavity or compartment away from the other supplies to avoid inadvertent marking of the paper.

SUMMARY OF THE INVENTION

The present invention accomplishes these objectives by providing a caddy for storing and transporting art supplies which includes at least two pivotably coupled trays disposed in substantially parallel, vertically displaced, planes. Access to the contents of the lower tray or trays is obtained by pivoting one or more of the trays.

More specifically, the caddy includes a first tray disposed in a first plane and having a bottom and a perimeter wall defining a first storage cavity for storing art supplies and a second tray which is pivotably coupled to the first tray. The second tray is disposed in a second plane substantially parallel to the first plane and includes a bottom and a perimeter wall defining a second storage cavity for storing art supplies. In one embodiment of the invention, the second tray is disposed above the first tray, and the second tray is pivotable in the second plane to provide access to the first storage cavity. In another embodiment, the second tray is disposed beneath the first tray such that pivoting the first tray with respect to the second tray (or vice versa) provides access to the second storage compartment.

In other embodiments the caddy is provided with a third tray. This third tray is disposed in the second plane adjacent the second tray and includes a bottom and a perimeter wall defining a third storage cavity for storing art supplies. The third tray, like the second tray, is pivotably coupled to the first tray for pivoting in the second plane. This third tray can be added to either of the embodiments discussed above. Thus, the third tray can be pivotable in the second plane to provide access to the first storage cavity or it can be pivotable in the second plane to provide access to the third storage cavity.

In any of these embodiments, the first tray is preferably dimensioned to store paper. Therefore, the caddy can preferably be used to transport art supplies such as drawing or painting utensils as well as paper.

These and other features and advantages of the invention will be more readily apparent upon reading the following description of the exemplary embodiments of the invention and upon reference to the accompanying drawings wherein:

DESCRIPTION OF THE EXEMPLARY EMBODIMENTS

Figure 1:
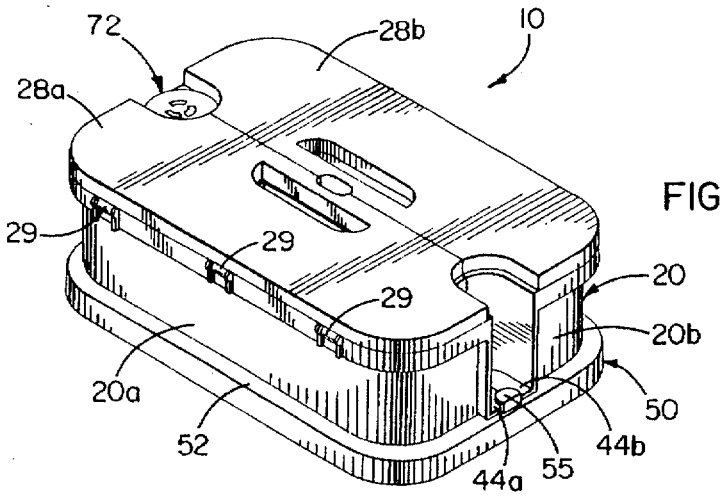
FIG. 1 is a left, front perspective view of a caddy constructed in accordance with the teachings of the present invention.

A caddy 10 constructed in accordance with the teachings of the present invention is shown generally in FIG. 1. The caddy 10 is preferably constructed to provide a separate storage cavity for storing paper and at least one other storage cavity for storing other art supplies such as drawing or writing utensils, glue, scissors, and paints. To this end, the caddy 10 includes at least two pivotably coupled trays 20, 50 disposed in two substantially parallel planes. As illustrated in FIG. 1, the trays 20, 50 are preferably coupled such that the upper tray 20 can be positioned adjacent the lower tray 50. Thus, the upper tray 20 forms a lid covering the lower tray 50 to enclose the contents of the lower tray 50 during transportation and storage.

Figure 9:
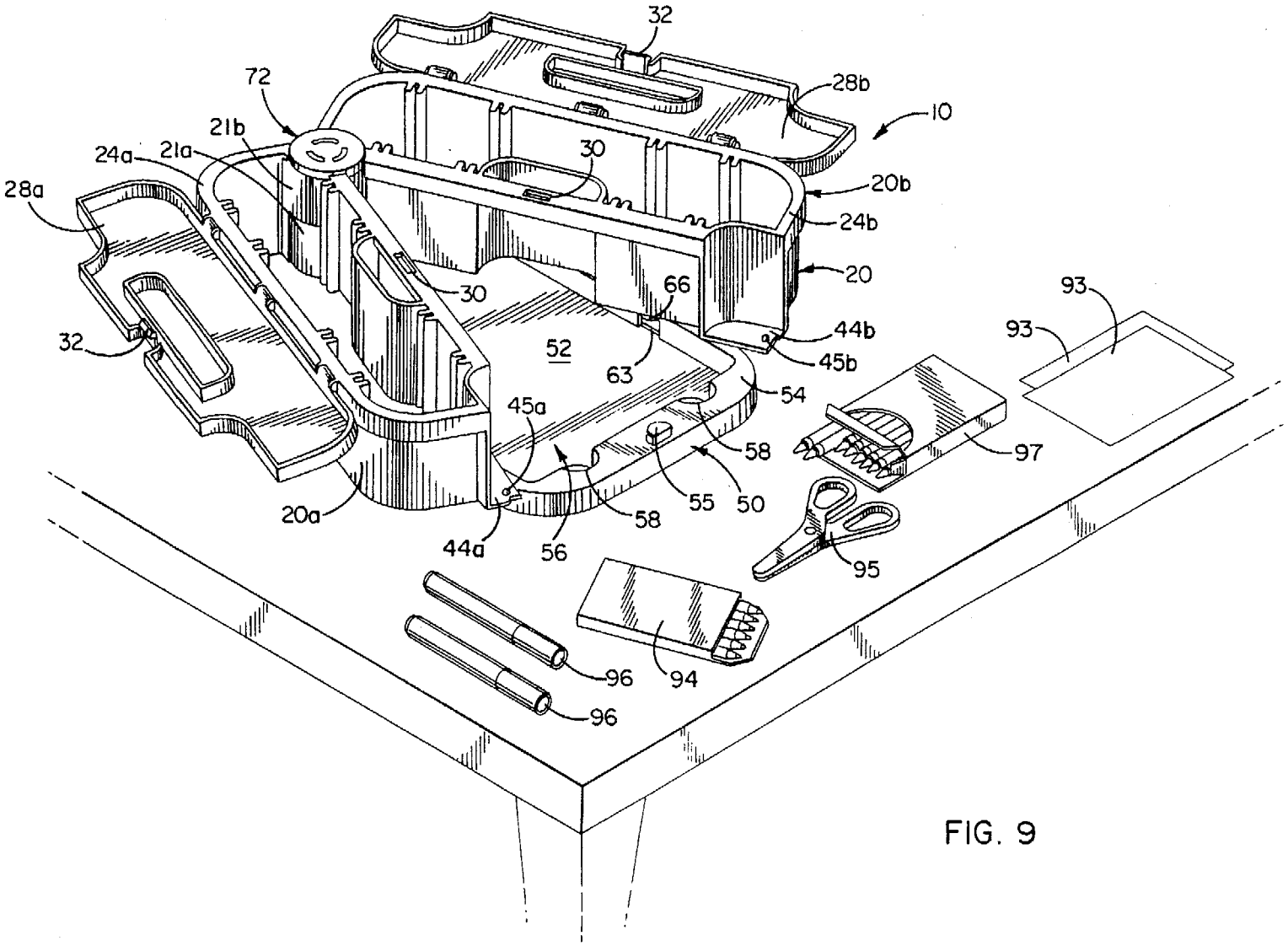
FIG. 9 is a left, front perspective view similar to FIG. 8, but showing the caddy with its upper trays pivoted to provide access to the lower storage cavity.
Figure 11:
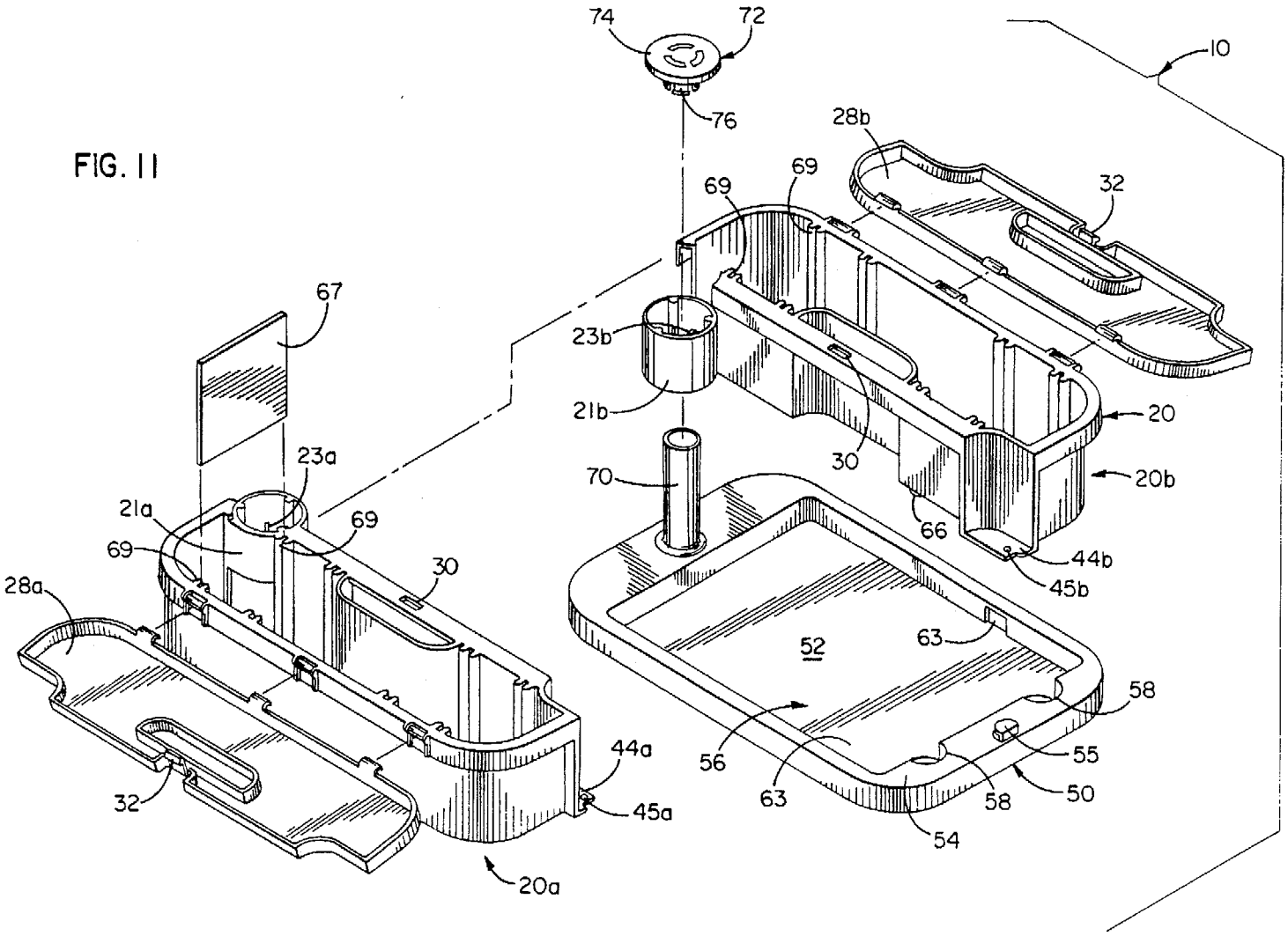
FIG. 11 is an exploded view of the caddy of FIG. 1.

It will be appreciated by those skilled in the art that, although the caddy 10 can be constructed with only two trays 20, 50 without departing from the scope or spirit of the instant invention, in this embodiment the upper tray 20 actually comprises two separate trays 20*a*, 20*b* as most easily seen in FIGS. 9 and 11. Thus, although the remaining description will describe the caddy 10 as including three storage trays 20*a*, 20*b*, 50, it will be appreciated by those skilled in the art that the caddy 10 can be constructed with two, four, or even more trays without departing from the scope or spirit of the instant invention.

Turning back to the embodiment illustrated in FIG. 1, it can be seen that the lower tray 50 is preferably a substantially rectangular structure whose width and length are significantly larger than its height. As most easily seen in FIG. 11, the lower tray 50 includes a bottom 52 and a perimeter wall 54. The bottom 52 and perimeter wall 54 combine to define a substantially rectangular storage cavity 56 which is preferably dimensioned to receive and store a stack of 8½ inch×11 inch paper. However, it will be appreciated by those skilled in the art that both the storage cavity 56 and the lower tray 50 can have many sizes and shapes without departing from the scope or spirit of the invention. Nonetheless, it should be noted that, in this embodiment, the lower tray has a height of approximately 1 inch (2.54 cm), a length of about 14 and ¾ inches (37.5 cm), and a width of about 9 and ⅜ inches (23.8 cm) and the storage cavity 56 of the lower tray 50 has a depth of approximately ¾ inches (1.9 cm), a length of about 11 and ¼ inches (28.6 cm) and a width of about 8 and ¾ inches (22.2 cm).

Figure 5:
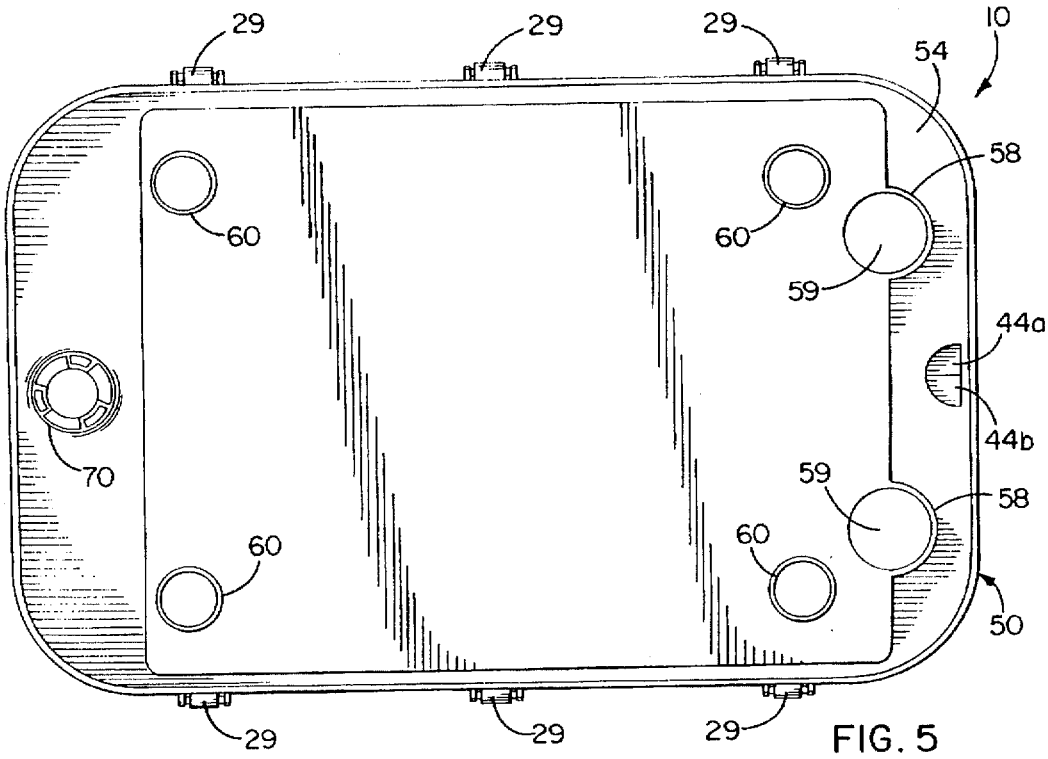
FIG. 5 is a bottom plan view of the caddy of FIG. 1.
Figure 6:
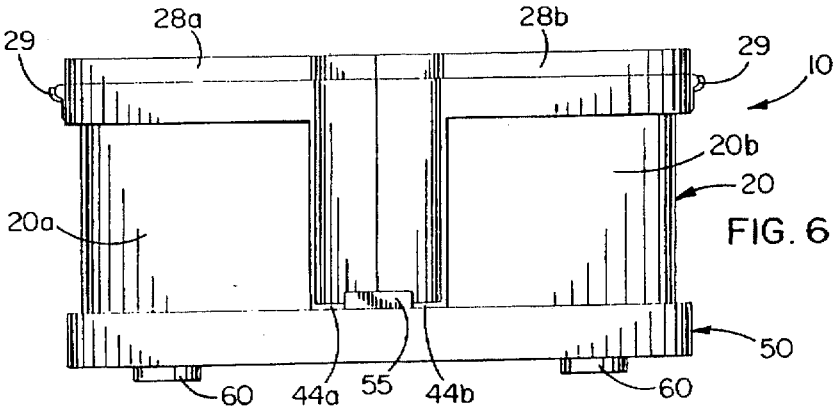
FIG. 6 is a front elevational view of the caddy of FIG. 1.
Figure 10:
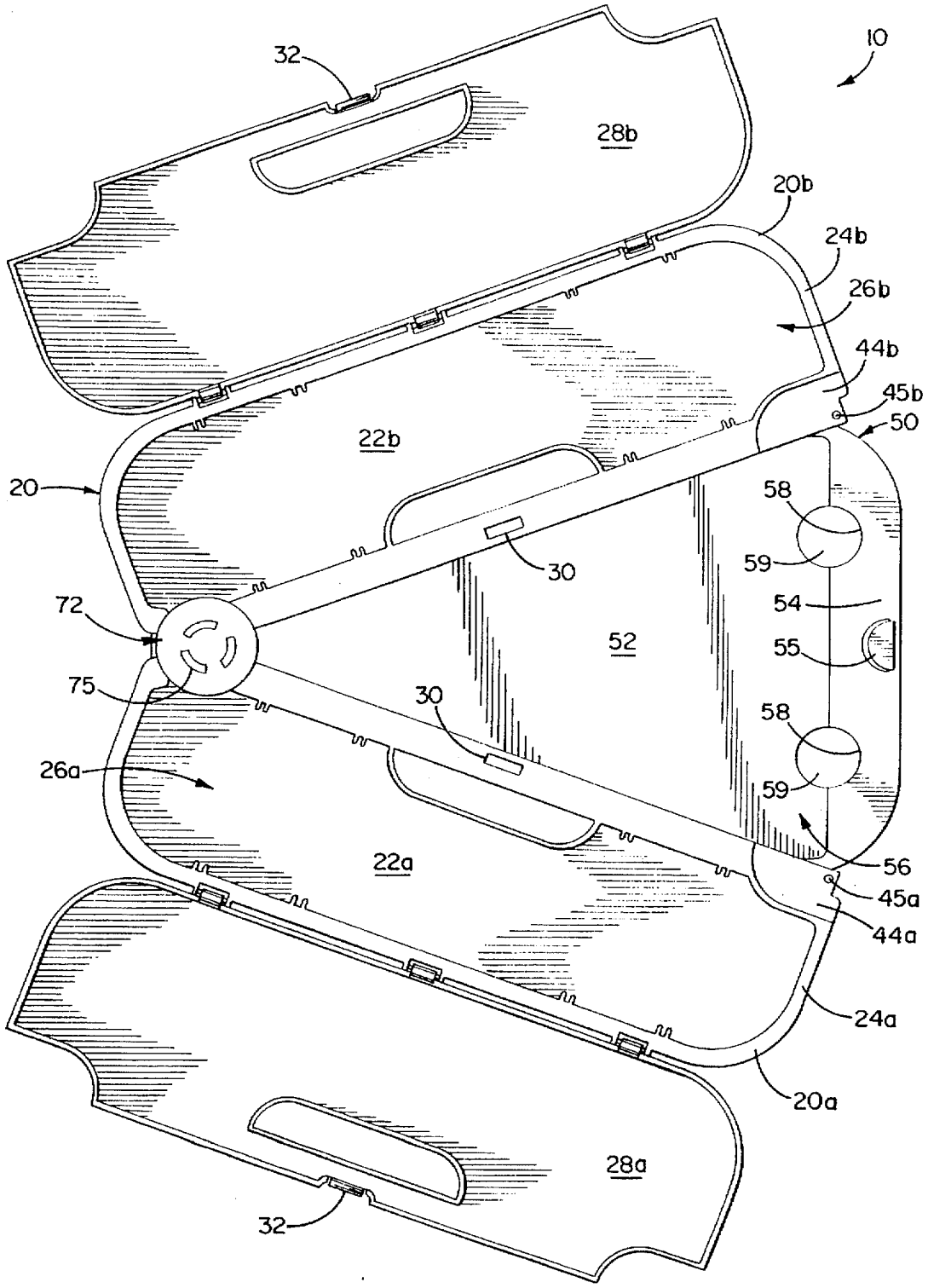
FIG. 10 is a top plan view of the caddy of FIG. 1, but showing the caddy with its upper trays pivoted to provide access to the lower storage cavity and with the lids of the upper trays open to provide access to the upper storage cavities.

The perimeter wall 54 of the lower tray 50 includes several features which should be noted. For example, in order to facilitate the withdrawal of paper stored in the storage cavity 56, the perimeter wall 54 of the lower tray 50 is provided with finger recesses 58. These finger recesses 58 enable a user to insert their finger under one or more sheets of paper for easy removal. In order to further ease removal of paper from the storage cavity 56, the bottom 52 of the lower tray 50 includes circular bores 59 positioned adjacent the finger recesses 58 of the perimeter wall 54. As illustrated in FIGS. 5 and 10, these bores 59 permit a user to easily insert a finger beneath the stored paper thereby obviating the need for crumpling the paper to obtain a secure grip during removal. As also illustrated in FIG. 5, the bottom 52 of the lower tray 50 preferably includes legs 60 which support the tray 50 (and the caddy 10). These legs 60 lift the tray 50 away from the ground thereby insuring that the bores 59 provide clearance for inserting a finger beneath the stored paper.

Turning back to FIG. 11, it can be seen that the lower tray 50 is preferably provided with a cylindrical post 70 for coupling the lower tray 50 to the upper trays 20*a*, 20*b*. This post 70, which is preferably positioned at a substantially right angle to the surface of the perimeter wall 54 (i.e., substantially perpendicular to the planes of the upper and lower trays 20*a*, 20*b*, 50), preferably has a substantially circular cross-section. Although it will be appreciated by those skilled in the art that the post 70 could be affixed to the lower tray 50 via many mechanical or chemical means without departing from the scope or spirit of the invention, in this embodiment the post 70 is integrally formed with the perimeter wall 54 of the lower tray 50.

As illustrated in FIG. 11, the upper trays 20*a*, 20*b* are each preferably provided with a projection 21*a*, 21*b* for coupling the upper trays 20*a*, 20*b* to the lower tray 50. More specifically, the projections 21*a*, 21*b* of the upper trays 20*a*, 20*b* each define a cylindrical bore and six fins 23*a*, 23*b* which are dimensioned to slidably receive the post 70 of the lower tray 50. When the bores and fins 23*a*, 23*b* operatively engage the post 70 of the lower tray 50, the upper trays 20*a*, 20*b* can be pivoted relative to the lower tray 50 (and vice versa) as illustrated in FIGS. 9 and 10 to provide selective access to the storage cavity 56 of the lower tray 50. It should be noted in this regard that, for purposes of this application, the term "access" shall mean at least partial access. It should further be noted that although this description often refers to pivoting the upper trays 20*a*, 20*b* relative to the lower tray 50, the opposite action, (i.e.) pivoting the lower tray 50 relative to the upper trays 20*a*, 20*b* could also be used to the same effect.

It should also be noted that in order to prevent the upper trays 20*a*, 20*b* from separating from the lower trays 50, the caddy 10 is further provided with a cap 72. As illustrated in FIG. 11, the cap 72 includes a circular lid 74 of substantially the same diameter as the projections 21*a*, 21*b* of the upper trays 20*a*, 20*b* and openings 75. The cap 72 also includes a series of downwardly directed tabs 76 positioned in a circular configuration for engaging a rim disposed within the cylindrical post 70 to prevent the cap 72 from being removed. Thus, the post 70, the projections 21*a*, 21*b*, and the cap 72 all combine to hold the lower and upper trays 50, 20*a*, 20*b* in operative engagement.

Figure 7:
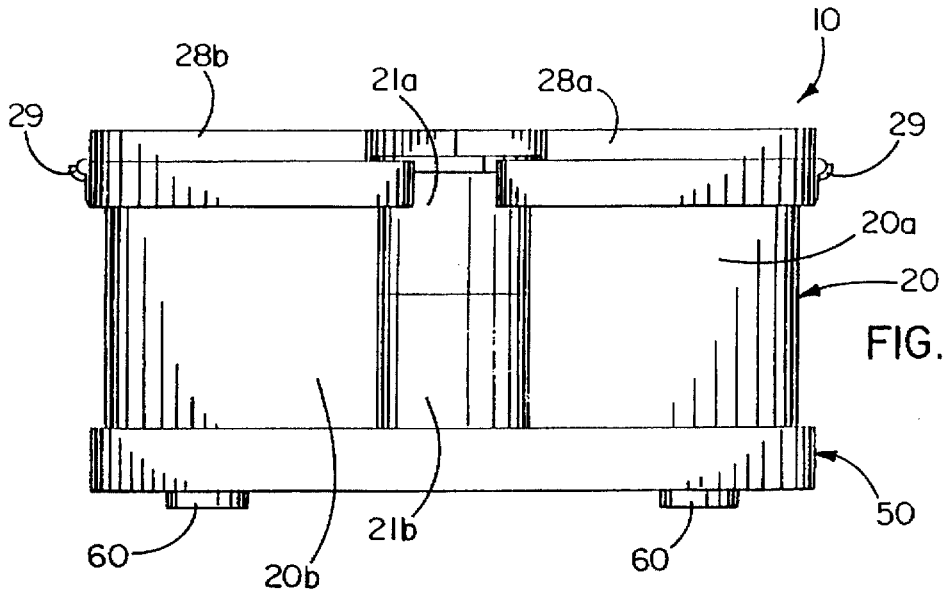
FIG. 7 is a rear elevational view of the caddy of FIG. 1.

Turning to the upper trays 20*a*, 20*b* themselves, it can be seen that the two upper trays 20*a*, 20*b* are preferably substantially symmetrical structures. However, as illustrated in FIGS. 7 and 11, the projection 21*a* of the left upper tray 20*a* is positioned above the projection 21*b* of the right upper tray 20*b* to enable both projections 21*a*, 21*b* to engage the post 70 simultaneously. In all other respects, the upper trays 20*a*, 20*b* are preferably symmetrical. Consequently, in the remaining description the upper trays 20*a*, 20*b* will not be treated separately and the individual components of the trays 20*a*, 20*b* will be similarly numbered and will include the letter "a" or "b" to signify its correspondence with either upper tray 20*a* or upper tray 20*b*, respectively.

As illustrated in FIG. 9, the upper trays 20*a*, 20*b* are preferably substantially rectangular structures whose lengths are significantly longer than their widths and heights. As most easily seen in FIG. 10, the upper trays 20*a*, 20*b* each include a bottom 22*a*, 22*b* and a perimeter wall 24*a*, 24*b* which combine to define a substantially rectangular storage cavity 26*a*, 26*b* that is preferably dimensioned to receive and store art supplies such as crayons, coloring pencils, paint brushes, glue, and scissors. However, it will be appreciated by those skilled in the art that the storage cavities 26*a*, 26*b* and the upper trays 20*a*, 20*b* can be constructed to have many sizes and shapes without departing from the scope or spirit of the invention. Nonetheless, it should be noted that, in this embodiment, the upper trays 20*a*, 20*b* have a height of approximately 3 and ⅝ inches (9.2 cm), a length of about 14 and ¾ inches (37.5 cm), and a width of approximately 4 and ⅝ inches (11.7 cm) and the storage cavities 26*a*, 26*b* have a depth of approximately 3 and ½ inches (8.9 cm), a length of approximately 14 and ¼ inches (36.2 cm) and a width of about 3 and ¾ inches (9.5 cm).

It should further be noted that, as illustrated in FIG. 11, the upper trays 20*a*, 20*b* are preferably provided with movable dividers 67 and mating receiving slots 69 which enable a user to divide the trays 20*a*, 20*b* into multiple compartments for storing art supplies. It will, of course, be appreciated by those skilled in the art that although only one divider is illustrated in the figures, in this embodiment multiple dividers are provided in order to enable the user to divide the upper trays 20*a*, 20*b* in many ways.

Figure 2:
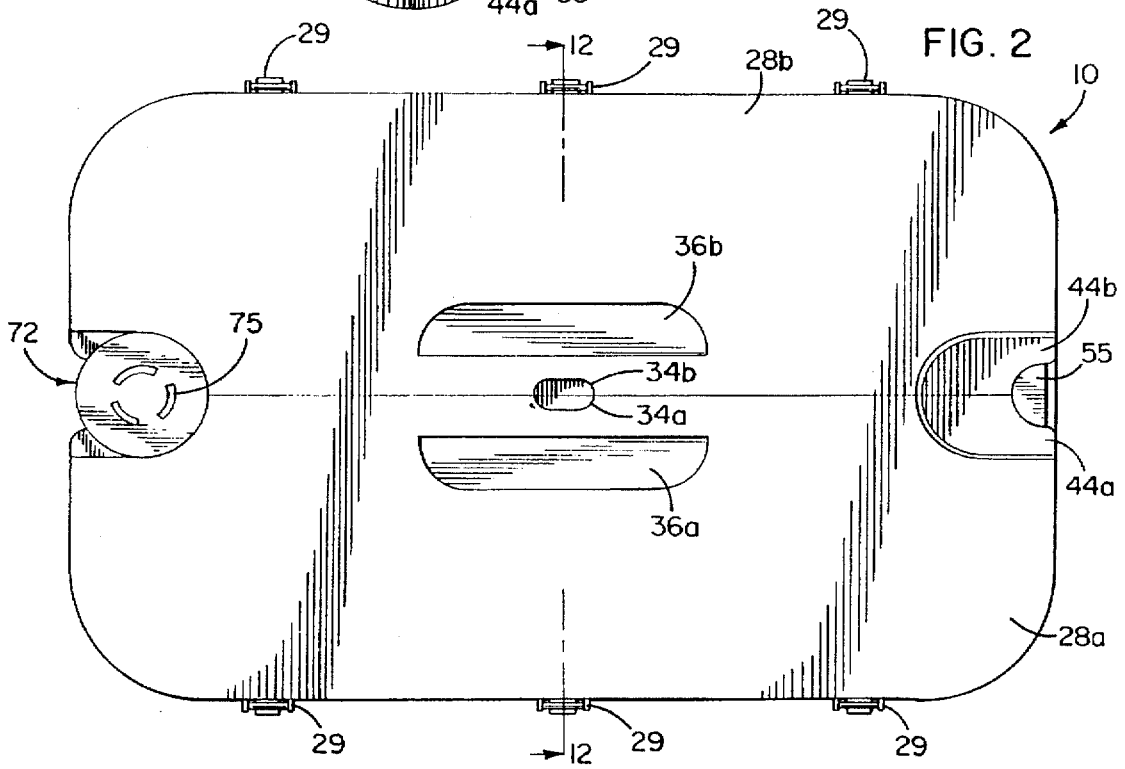
FIG. 2 is a top plan view of the caddy of FIG. 1.
Figure 3:
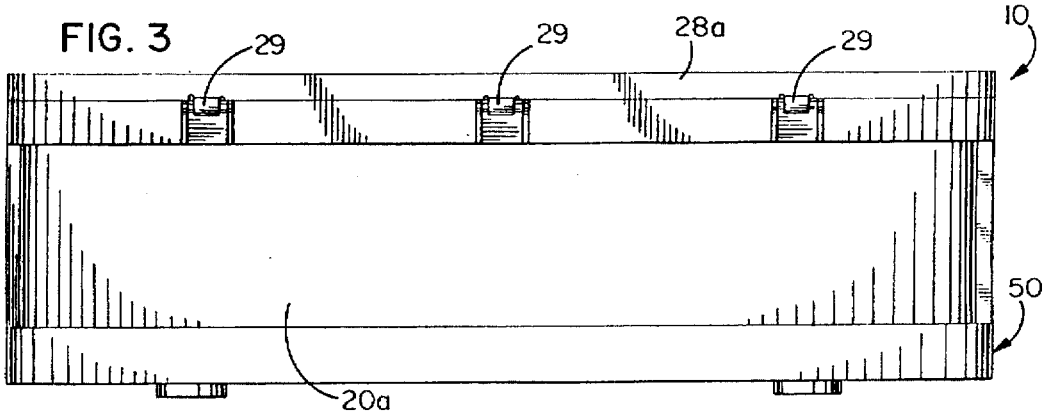
FIG. 3 is a left side elevational view of the caddy of FIG. 1.
Figure 4:
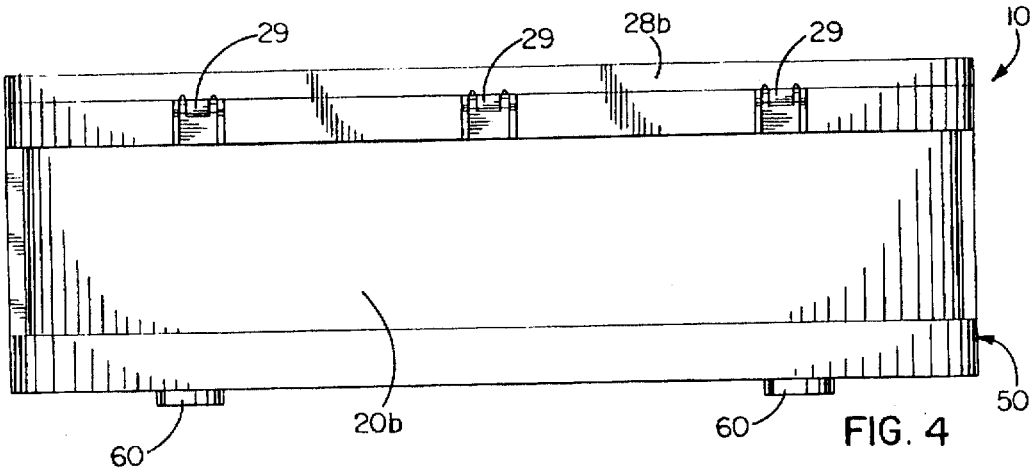
FIG. 4 is a right side elevational view of the caddy of FIG. 1.

In order to prevent the contents of their storage cavities 26*a*, 26*b* from spilling during transportation and the like, the upper trays 20*a*, 20*b* are preferably provided with lids 28*a*, 28*b* as illustrated in FIGS. 1 and 2. These lids 28*a*, 28*b*, which are preferably dimensioned to operatively engage the outer edges of the perimeter walls 24*a*, 24*b* thereby covering the storage cavities 26*a*, 26*b*, are preferably connected to the perimeter walls 24*a*, 24*b* via hinges 29 as illustrated in FIGS. 3 and 4. Thus, in order to gain access to the contents of the storage cavities 24*a*, 24*b* of the upper trays 20*a*, 20*b*, a user must pivot the lids 28*a*, 28*b* open as illustrated in FIGS. 8, 9 and 10.

Figure 8:
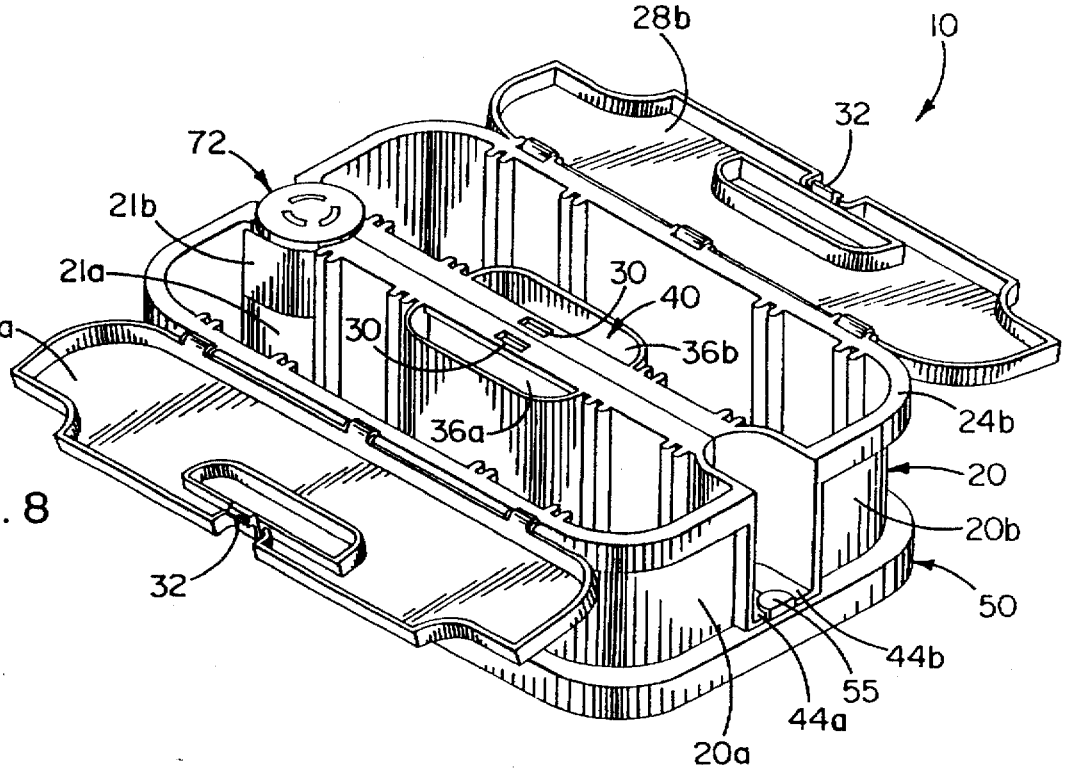
FIG. 8 is a left, front perspective view similar to FIG. 1, but showing the caddy with the lids of the upper trays in an open position.
Figure 12:
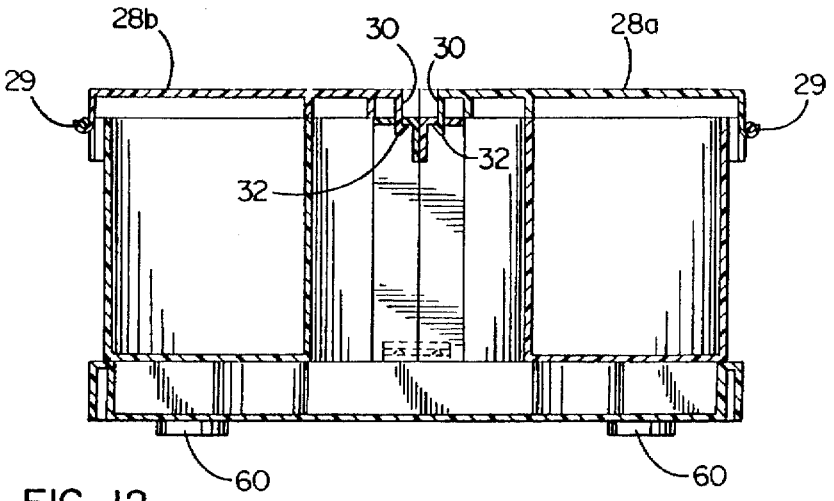
FIG. 12 is a cross-sectional view taken along lines 12—12 of FIG. 2.

In order to insure that the lids 28*a*, 28*b* do not inadvertently open when the caddy 10 is transported, the lids 28*a*, 28*b* are provided with tabs 32 which operatively engage recesses 30 disposed in the perimeter walls 24*a*, 24*b* of the upper trays 20*a*, 20*b* as shown in FIG. 8. As illustrated in FIG. 12, when the lids 28*a*, 28*b* are closed, their tabs 32 are received by the recesses 30 such that the tabs 32 engage the undersurface of the perimeter walls 24*a*, 24*b* and thereby prevent the lids 28*a*, 28*b* from opening. As best seen in FIGS. 1 and 2, the user can then open the lids 28*a*, 28*b* by pushing the tabs 32 to the side and lifting such that the tabs 32 move free of the undersurface of the perimeter walls 24*a*, 24*b* and pass through the recesses 30. In order to facilitate this opening process, the lids 28*a*, 28*b* are dimensioned with finger recesses 34*a*, 34*b* as illustrated in FIG. 2.

Transportation of the caddy 10 is facilitated by the inclusion of hand wells 36*a*, 36*b* in the lids 28*a*, 28*b* as shown in FIG. 2. As best seen in FIGS. 8 and 9, the perimeter walls 24*a*, 24*b* are contoured to define a central pocket 40 between the two upper trays 20*a*, 20*b* when the trays 20*a*, 20*b* are positioned as shown in FIG. 8. The hand wells 36*a*, 36*b* of the lids 28*a*, 28*b* and the central pocket 40, thus combine to form a handle for transporting the caddy 10. It will be appreciated by those skilled in the art that the tabs 32 and recesses 30 described above serve to keep the lids 28*a*, 28*b* closed when carrying the caddy 10 in this manner.

As illustrated in FIGS. 1, 6, 8 and 9, the upper trays 20*a*, 20*b* are further provided with tabs 44*a*, 44*b* which combine with a platform 55 disposed on the perimeter wall 54 of the lower tray 50 to prevent the upper and lower trays 20*a*, 20*b*, 50 from inadvertently pivoting relative to one another during transportation. As best seen in FIG. 9, the tabs 44*a*, 44*b* of the upper trays 20*a*, 20*b* each include a protrusion 45*a*, 45*b* which engages a mating protrusion on the underside of platform 55 to lock the upper trays 20*a*, 20*b* in the position illustrated in FIG. 1 for transportation. This engagement can be released by providing a sidewise, pivoting force to the trays 20*a*, 20*b* when the user wants access to the lower tray 50.

It should be noted that, although in this embodiment the platform 55 is provided with protrusions for engaging the protrusions 45*a*, 45*b*, indents on the undersurface of platform 55 for mating with the protrusions 45*a*, 45*b* could likewise be employed without departing from the scope or spirit of the invention. Similarly, it will be appreciated by those skilled in the art that although the platform 55 is preferably integrally formed with the perimeter wall 54 of the lower tray 50, the platform 55 could be affixed to the lower tray 50 by many mechanical or chemical means without departing from the invention. In addition, it should be noted that, although the upper trays 20*a*, 20*b* have been illustrated as pivoting with their lids 28*a*, 28*b* in the open position, in this embodiment the upper trays 20*a*, 20*b* can pivot whether their lids 28*a*, 28*b* are open or closed.

As illustrated in FIGS. 9 and 11, the perimeter wall 54 of the lower tray 50 is provided with a recess 63 on each of the two long sides of the storage cavity 52. These recesses 63 are positioned to selectively mate with tabs 66 on the bottom of the upper trays 20*a*, 20*b* when the upper trays 20*a*, 20*b* are pivoted as illustrated in FIG. 9. These recesses 63 and tabs 66, therefore, combine to limit the pivoting motion of the upper trays 20*a*, 20*b*. In this embodiment, however, a user can overcome this feature by applying an upwardly directed force to the upper trays 20*a*, 20*b* as they pivot so that the tabs 66 pass above the perimeter wall 54 of the lower tray 50 instead of engaging the recesses 66. This ability to bypass the pivot limiting feature of the caddy 10 enables a user to selectively gain access to a larger area of the storage cavity 56 of the lower tray 50. It will, of course, be appreciated by those skilled in the art that the tabs 66 and recesses 63 can be omitted from the caddy 10.

It should be noted that the caddy 10 and all of its components are preferably constructed from molded plastic. However, it will be appreciated by those skilled in the art that the caddy 10 could be constructed from other materials such as wood without departing from the scope or spirit of the invention.

Figure 15:
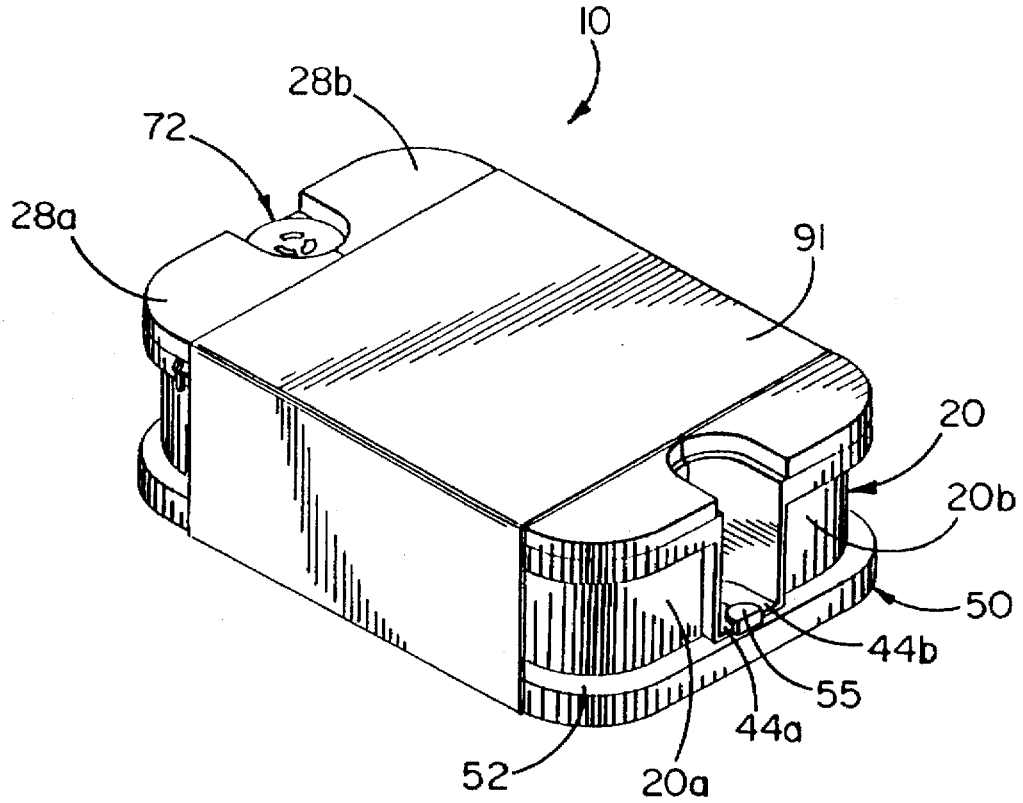
FIG. 15 is a left, front perspective view of the caddy similar to FIG. 1 but showing the caddy in its packaging.

It should further be noted that the caddy 10 can be packaged in a cardboard enclosure 91 to insure the caddy remains closed during shipping and handling as illustrated in FIG. 15. If desired, either the caddy 10 or the caddy and the enclosure 91 can be wrapped in cellophane or the like to protect the caddy from becoming soiled during shipment and handling. Although in this embodiment, the cardboard enclosure 91 is a sleeve or a wrap, it will be appreciated that other enclosures such as a box might also be appropriate.

It should also be noted that, although other art supplies and paper types could be included in the caddy, in this embodiment the caddy 10 includes construction paper 93 in its lower tray 50 and a box of colored pencils 94, scissors 95, two markers 96, and a box of crayons 97 as shown in FIG. 9.

Figure 13:
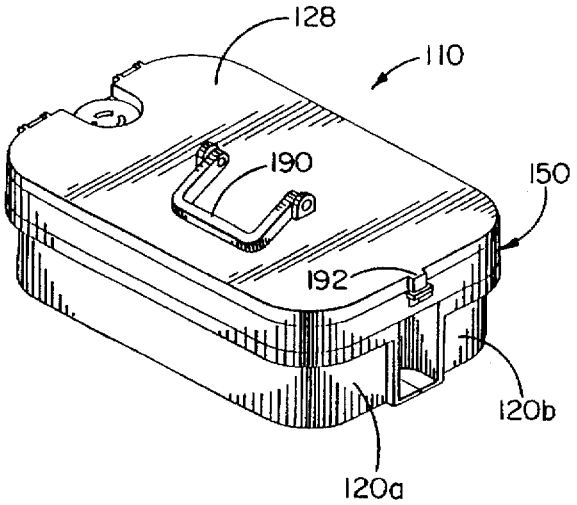
FIG. 13 is a left, front perspective view of an alternative caddy constructed in accordance with the teachings of the present invention.
Figure 14:
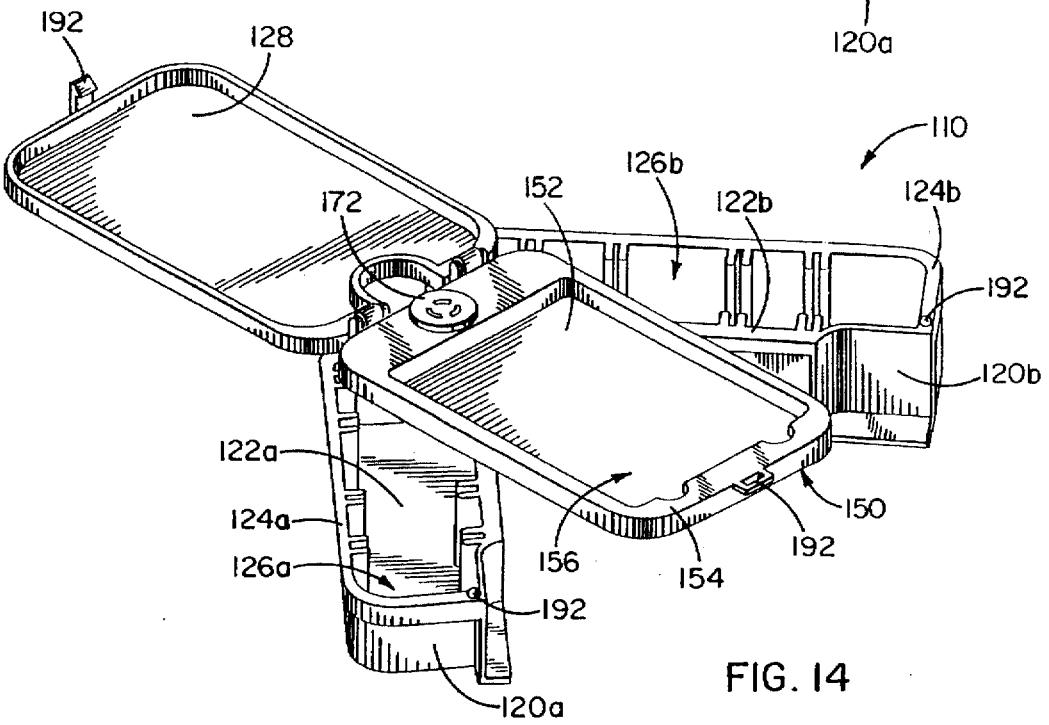
FIG. 14 is a left, front perspective view similar to FIG. 13, but showing the caddy with the lower trays pivoted to provide access to the lower storage cavities and the lid of the upper tray opened to provide access to the upper storage cavity.

An alternative caddy 110 constructed in accordance with the teachings of the instant invention is illustrated in FIGS. 13 and 14. As those skilled in the art will readily appreciate, the alternative caddy 110 is substantially similar to the caddy 10 illustrated in FIGS. 1–12. However, in the alternative caddy 110 the relative positions of the pivotable trays have been reversed. Specifically, the alternative caddy 110 includes a single upper tray 150 having a bottom 152 and a perimeter wall 154 which combine to define a storage cavity 156 that is preferably dimensioned to store 8-½ inch by 11 inch paper. The caddy 110 also includes two lower trays 120*a*, 120*b* each of which includes a bottom 122*a*, 122*b* and a perimeter wall 124*a*, 124*b* which combine to define a storage cavity 126*a*, 126*b* that is preferably dimensioned to store art supplies such as crayons, pencils, scissors, paints and glue. Because of the reversal in the relative positions of the trays, the upper paper tray 150 now includes a lid 128 which is hinged to the perimeter wall 154 of the upper tray 150 to provide selective access to storage cavity 156. In the alternative, the lid 128 could be pivotally attached to cap 172 so that the lid 128 could be pivoted with respect to the upper tray 150. Similarly, since the upper tray 150, now, in effect, provides a lid for the storage cavities 126*a*, 126*b* of the lower trays 120*a*, 120*b*, the lower trays 120*a*, 120*b* do not include separate lids. The storage cavities 126*a*, 126*b* can be accessed by pivoting the lower trays 120*a*, 120*b* as illustrated in FIG. 14 (or by pivoting the upper tray 150 with respect to the lower trays 120*a*, 120*b*).

It will readily be appreciated by those skilled in the art that the alternative caddy 110 can be provided with various handles for transporting the caddy 110 and various latches for preventing inadvertent pivoting of the trays 120*a*, 120*b*, 150 during transportation. A representative handle 190 and representative latches 192 are shown in FIGS. 13 and 14 for illustrative purposes. However, it will be appreciated by those skilled in the art that other handles and latches might likewise be employed without departing from the invention.

In summary, it will be appreciated by those skilled in the art that a unique caddy for storing and transporting art supplies has been shown and described in this application. The caddy offers users the ability to store paper and other art supplies in separate storage cavities of a single unit in order to avoid soiling during transportation.

While particular embodiments of the invention have been shown, it will be understood, of course, that the invention is not limited thereto. Since modifications may be made to the disclosed structures by these skilled in the art particularly in light of the foregoing teachings without departing from the invention, the appended claims are intended to cover all structures, regardless of modifications, that fall within the scope and spirit of the instant invention whether or not such structures are specifically described herein.

What is claimed is:

1. A caddy for staring and transporting art supplies comprising:

a first tray disposed in a first plane, the first tray having a post, a bottom and a perimeter wall defining a first storage cavity for storing art supplies;

a second tray having a first projection operatively engaging the post to pivotably couple the second tray to the first tray, the second tray being disposed in a second plane substantially parallel to the first plane and having a bottom and a perimeter wall defining a second storage cavity for storing art supplies; and, a third tray disposed in the second plane adjacent the second tray, the third tray having a second projection operatively engaging the post to pivotably couple the third tray to the first tray, the third tray further including a bottom and a perimeter wall defining a third storage cavity for storing art supplies.

2. A caddy as defined in claim 1 wherein the first tray includes a handle.

3. A caddy as defined in claim 1 further comprising:

a lid operatively connected to the second tray to selectively provide access to the second storage compartment.

4. A caddy as defined in claim 3 wherein the lid is operatively connected to the perimeter wall of the second tray by at least one hinge.

5. A caddy as defined in claim 3 further comprising a latch for selectively securing the lid to second tray to prevent the lid from opening.

6. A caddy as defined in claim 1 further comprising a mechanism for selectively preventing the second tray from pivoting relative to the first tray.

7. A caddy as defined in claim 1 wherein the first storage cavity is dimensioned to store paper.

8. A caddy as defined in claim 7 wherein the bottom of the first storage cavity includes a recess to facilitate paper removal.

9. A caddy as defined in claim 1 further comprising movable dividers for selectively dividing the second storage cavity into compartments.

10. A caddy as defined in claim 2 further comprising a cap operatively engaging the post.

11. A caddy as defined in claim 1 wherein the second and third trays are pivotable in the second plane to provide access to the first storage cavity.

12. A caddy as defined in claim 13 wherein the second and third trays each include a handle.

13. A caddy as defined in claim 11 further comprising:

a first lid operatively connected to the second tray to selectively provide access to the second storage compartment; and, a second lid operatively connected to the third tray to selectively provide access to the third storage compartment.

14. A caddy as defined in claim 13 wherein the first lid is operatively connected to the perimeter wall of the second tray by at least one hinge, and the second lid is operatively connected to the perimeter wall of the third tray by at least one hinge.

15. A caddy as defined in claim 13 further comprising a first latch for selectively securing the first lid to the second tray to prevent the first lid from opening and a second latch for selectively securing the second lid to the third tray to prevent the second lid from opening.

16. A caddy as defined in claim 11 further comprising a mechanism for selectively preventing the second tray from pivoting relative to the first tray and a mechanism for selectively preventing the third tray from pivoting relative to the first tray.

17. A caddy as defined in claim 11 wherein the first storage cavity is dimensioned to store paper.

18. A caddy as defined in claim 11 further comprising movable dividers for selectively dividing the second and third storage cavities into compartments.

19. A caddy as defined in claim 1 wherein the second tray is pivotable in the second plane to provide access to the second storage cavity.

20. A caddy as defined in claim 19 wherein the third tray is pivotable in the second plane to provide access to the third storage cavity.

21. A caddy as defined in claim 20 wherein the first tray includes a handle for transporting the caddy.

22. A caddy as defined in claim 20 further comprising:

a first lid operatively connected to the first tray to selectively provide access to the first storage compartment.

23. A caddy as defined in claim 20 further comprising a latch for selectively preventing the second tray from pivoting relative to the first tray and a latch for selectively preventing the third tray from pivoting relative to the first tray.

24. A caddy as defined in claim 20 wherein the first storage cavity is dimensioned to store paper.

25. A caddy as defined in claim 20 further comprising movable dividers for selectively dividing the second and third storage cavities into compartments.

26. A portable caddy for storing and transporting art supplies comprising:

a paper tray disposed in a first plane, the paper tray having a post, and further including a bottom and a perimeter wall defining a paper storage cavity;

a first supply tray disposed above the paper tray, the first supply tray having a projection operatively engaging the post to pivotably couple the first supply tray to the paper tray, the first supply tray also having a bottom and a perimeter wall defining a first supply storage cavity, the first supply tray being pivotable in a second plane substantially parallel to the first plane to provide access to the paper storage cavity; and, a second supply tray disposed in the second plane above the paper tray and adjacent to the first supply tray, the second supply tray having a bottom and a perimeter wall defining a second supply storage cavity, the second supply tray further including a projection operatively engaging the post to pivotably couple the second supply tray to the paper tray for pivoting in the second plane to provide access to the paper storage cavity.

27. A caddy for storing and transporting art supplies comprising:

a first tray disposed in a first plane, the first tray having a post, a bottom and a perimeter wall defining a first storage cavity for storing art supplies;

a second tray having a first projection operatively engaging the post to pivotably couple the second tray to the first tray, the second tray being disposed in a second plane substantially parallel to the first plane and having a bottom and a perimeter wall defining a second storage cavity for storing art supplies;

a third tray disposed in the second plane adjacent the second tray, the third tray having a second projection operatively engaging the post to pivotably couple the third tray to the first tray, the third tray further including a bottom and a perimeter wall defining a third storage cavity for storing art supplies; and an enclosure to insure the caddy remains closed during shipping and handling.

28. A caddy as defined in claim 27 wherein the enclosure is constructed from cardboard.

29. A caddy as defined in claim 27 wherein the enclosure comprises a cardboard sleeve.

30. A caddy as defined in claim 1 further comprising:

at least one of the group consisting of: paper, pencil, scissors, marker, and crayon.

31. A method for fabricating a caddy for storing paper and other art supplies comprising the steps of:

providing a first tray disposed in a first plane, the first tray having a post, and further including a bottom and a perimeter wall defining a first storage cavity dimensioned to store the paper;

providing a second tray having a first projection operatively engaging the post to pivotably couple the second tray to the first tray, the second tray having a bottom and a perimeter wall defining a second storage cavity dimensioned to store the other art supplies, the second tray being pivotable in a second plane substantially parallel to the first plane to provide access to the first storage cavity; and, providing a third tray disposed in the second plane adjacent to the second tray, the third tray having a bottom and a perimeter wall defining a third storage cavity, the third tray including a second projection operatively engaging the post to pivotably couple the third tray to the first tray for pivoting in the second plane to provide access to the first storage cavity.

* * * * *

UNITED STATES PATENT AND TRADEMARK OFFICE

CERTIFICATE OF CORRECTION

PATENT NO. : 5,676,240

DATED : October 14, 1997

INVENTOR(S) : David A. Cziraky et al

It is certified that error appears in the above-indentified patent and that said Letters Patent is hereby corrected as shown below:

In Claim 1, Column 7, line 44: "staring" should be --storing--.

In Claim 12, Column 8, line 23: "13" should be --11--.

Signed and Sealed this

Third Day of February, 1998

*Attest:*

Bruce Lehman

BRUCE LEHMAN

*Attesting Officer*

*Commissioner of Patents and Trademarks*